US005551412A

United States Patent [19]

Warnke

[11] Patent Number: 5,551,412

[45] Date of Patent: Sep. 3, 1996

[54] VERTICALLY ORIENTED SLINGSHOT RELEASE APPARATUS

[76] Inventor: Wesley J. Warnke, 7060 Binney St., Omaha, Nebr. 68104

[21] Appl. No.: 411,278

[22] Filed: Mar. 27, 1995

[51] Int. Cl.[6] ..... F41B 3/02

[52] U.S. Cl. ..... 124/20.1

[58] Field of Search ..... 124/20.1, 20.3, 124/21, 22

[56] References Cited

U.S. PATENT DOCUMENTS

| | | | |
|---|---|---|---|
| 2,638,885 | 5/1953 | Keadle | 124/20.1 |
| 2,708,924 | 5/1955 | Hurlburt | 124/17 |
| 3,277,878 | 10/1966 | Pankratz | 124/20.1 |
| 3,306,278 | 2/1967 | Spatari | 124/22 |
| 3,857,379 | 12/1974 | Burghardt | 124/20.1 |
| 3,949,729 | 4/1976 | Pfotenhauer | 124/20.1 X |
| 4,278,065 | 7/1981 | Wales | 124/20.1 |
| 4,784,106 | 11/1988 | Kees | 124/20.1 |

*Primary Examiner*—John A. Ricci
*Attorney, Agent, or Firm*—John A. Beehner

[57] ABSTRACT

A slingshot device for accurate shooting of a projectile having an elongated stationary support channel having forward and rearward portions. A movable carriage is slidably engaged by the stationary support channel and movable between an extended, forward cocked position and a retracted rearward holding position. A locking device is mounted on the forward portion of the elongated stationary support channel to releasably lock the carriage in the extended, forward cocked position. An elongated elastic band has opposite ends mounted in vertically spaced relation on the carriage. A pouch for releasably retaining the projectile is positioned at a midpoint of the elastic band device. A trigger is mounted on the stationary support channel and movable between an engagement position in releasable engagement with the pouch of the elastic band device, and a release position. Upon movement of the carriage to the forward cocked position, the elastic band is substantially stretched such that when the trigger is released, the elastic band is operative to propel a projectile in the pouch forwardly.

The slingshot apparatus may also include a sighting device mounted above the departure path of line of departure of the projectile. The sighting device may have a plurality of sighting apertures to accommodate different target distances.

11 Claims, 5 Drawing Sheets

VERTICALLY ORIENTED SLINGSHOT RELEASE APPARATUS

BACKGROUND OF THE INVENTION

1. Technical Field

The apparatus of the present invention relates generally to slingshots. More specifically, it relates to an apparatus for achieving a greater shot-to-shot release uniformity and velocity consistency and hence a greater accuracy. The invention also relates to a sighting apparatus used in conjunction with the slingshot which enables a more accurate sighting of the target.

Currently, most slingshot devices are adapted to be held by one hand and the projectile pouch retracted with the other hand. These devices have extremely large inaccuracies due to the inconsistent shot-to-shot release.

Since the initial velocity, at the point of release, is directly related to the tension in the elastic band at the time of release, it is also clear that these devices suffer from a great shot-to-shot inconsistency of initial velocity due to the inequality of tension placed on the elastic band. Consequently, in the interest of increasing accuracy, it is highly desirable to provide a slingshot apparatus wherein the initial velocity can be consistently maintained from one firing to the next.

2. Description of the Prior Art

Currently, prior art slingshot devices come in one of three typical embodiments. First is the simple hand-held "Y"-shaped stick. The second conventional configuration consists of a slingshot having a design similar to the first mentioned configuration but also having an additional wrist bar adapted to provide stability to the slingshot when the elastic band is being extended. In both of these first two conventional embodiments, the elastic band imparting the initial velocity to the projectile, is extended with the fingers of the operator's free hand. As is well understood in the art, these methods have a great targeting inaccuracy associated therewith due to the shot-to-shot inconsistency of release.

As also known in the art, the key to accuracy when using a slingshot apparatus is a consistent shot-to-shot initial velocity. In a slingshot, the initial velocity is determined by the amount of tension on the elastic band at the time of release. Furthermore, the amount of tension on the elastic band is directly proportional to the distance the band is extended. Thus, if the band is extended a consistent amount from one shot to the next, there is a high probability that the initial velocity will be the same from one shot to the next. A second factor, somewhat related to the first, is the manner in which the band is retracted and more importantly, the manner in which it is released.

Ideally, the elastic band would be extended, held, and released from a single point positioned precisely at the center of the band. Any deviation from a point release results in an uneven release sequence, meaning that some portion of the band is released earlier than some other point. Clearly, this results in some inaccuracies in that the initial projectile vector is not consistent. A third significant factor in accuracy involves the method used to sight the target.

As is well understood in the laws of physics, any object falling in the earth's gravitational field will have a downwardly directed acceleration vector of 32 feet per second, squared. Thus, based on a given amount of time, the vertical displacement of a object may be determined relative to its initial position. If the projectile is also given an initial horizontal velocity vector, its final position may be determined based on knowledge of this initial velocity vector and the elapsed time. A sight may be used to predict the impact point based on an alignment of a forward and rearward sighting points. It is highly desirable for this sighting mechanism to be positioned above the departure path, defined as the initial horizontal velocity vector of the projectile, so that the distance to the final trajectory impact point is maximized. It is clear to those in the art that such sighting considerations are especially important since the slingshot is a low velocity weapon.

A third conventional slingshot apparatus embodiment attempts to remove some of the shot-to-shot inconsistencies inherent in the completely manual embodiments discussed above. This third conventional embodiment is typified by the Kees U.S. Pat. Nos. 4,784,106 and 4,593,673 and Burghardt U.S. Pat. No. 3,857,379. In both of these patents, the elastic band is extended to the stretched position by a mechanical means. The slingshot may be released by a trigger mechanism disengaging the locking means which retains the elastic band in the extended, cocked position. In all three of these devices, the elastic band is mounted in the horizontal plane. This horizontal mounting of the elastic band presents severe problems regarding the sighting mechanism used or prevents the installation of a sighting mechanism altogether. For example, the Burghardt device is completely lacking in any type of sighting device. It is clear that if a sighting member is to be used with a device having a horizontally oriented elastic band, it will either have to be offset from the initial horizontal departure vector or it will necessarily need to be sighted below the horizontal departure plane. Otherwise, if the designer attempts to place the sighting mechanism in vertical alignment with the projectile pouch and in approximately the same horizontal departure plane, the sighting means will present an obstacle to the departure of the projectile. One attempted solution to this problem in Kees was to provide a flexible latex rubber sighting member as the forward sight.

The flexibility of the forward sight was designed to permit the projectile to pass freely thereby without disturbing its flight path even if it should contact the sighting member. However, clearly any physical contact by the projectile with the sighting member is going to alter the projectile's flight trajectory and thereby disturb the targeting accuracy. Conversely, if the sighting mechanism is placed below the projectile departure plane, the target distance is necessarily limited due to the flight trajectory of the projectile as described in more detail below.

Consequently, it is a primary objective of the present invention to provide an enhanced accuracy slingshot apparatus wherein the elastic bands are oriented vertically such that the sighting means may be placed above and in alignment with the departure vector so as to enhance the overall accuracy of the device while providing a maximum targeting distance.

Another objective is to provide an improved accuracy slingshot apparatus wherein the release mechanism is operative to secure and release the projectile pouch from as nearly a single point of contact as possible so as to facilitate a uniform release or initial projectile vector.

Another objective is to provide an improved accuracy slingshot apparatus wherein the degree of tension on the elastic band in the extended, cocked position may be adjusted.

Another objective of the improved accuracy slingshot apparatus of the present invention is to provide a device wherein the elastic band may be maintained in a retracted, holding position awaiting cocking of the apparatus wherein the elastic band is just slightly taut, thereby preventing any excess stretching of the band between shots.

Another objective of the present invention is to provide a sighting means which is positioned above and in vertical alignment with the line of departure for the projectile, thereby increasing its effective range.

A further objective of the present invention is to provide an improved accuracy slingshot apparatus wherein a sighting means may be employed having a plurality of sighting apertures corresponding to a plurality of terminal target distances.

A further objective of the present invention is to provide an improved accuracy slingshot apparatus maximizing the shot-to-shot consistency of the projectile initial velocity.

Another objective of the present invention is to provide an apparatus wherein the handgrips of the apparatus may be adjusted to accommodate the arm lengths of different individuals.

SUMMARY OF THE INVENTION

A slingshot device for accurate shooting of a projectile having an elongated stationary support channel having forward and rearward portions. A movable carriage is slidably engaged by the stationary support channel and movable between an extended, forward cocked position and a retracted rearward holding position. A locking device is mounted on the forward portion of the elongated stationary support channel and operative to releasably lock the carriage in the extended, forward cocked position. An elongated elastic band is mounted in vertically on the carriage. A pouch for releasably retaining the projectile is positioned at a midpoint of the elastic band device. A trigger is mounted on the stationary support channel and movable between an engagement position in releasable engagement with the pouch of the elastic band device, and a release position. Upon movement of the carriage to the forward cocked position, the elastic band is substantially stretched such that when the trigger is released, the elastic band is operative to propel a projectile in the pouch forwardly.

The slingshot apparatus may also include a sighting device mounted above the departure path or line of departure of the projectile. The sighting device may have a plurality of sighting apertures to accommodate different targeting distances.

DESCRIPTION OF THE PREFERRED EMBODIMENT

Figure 1:
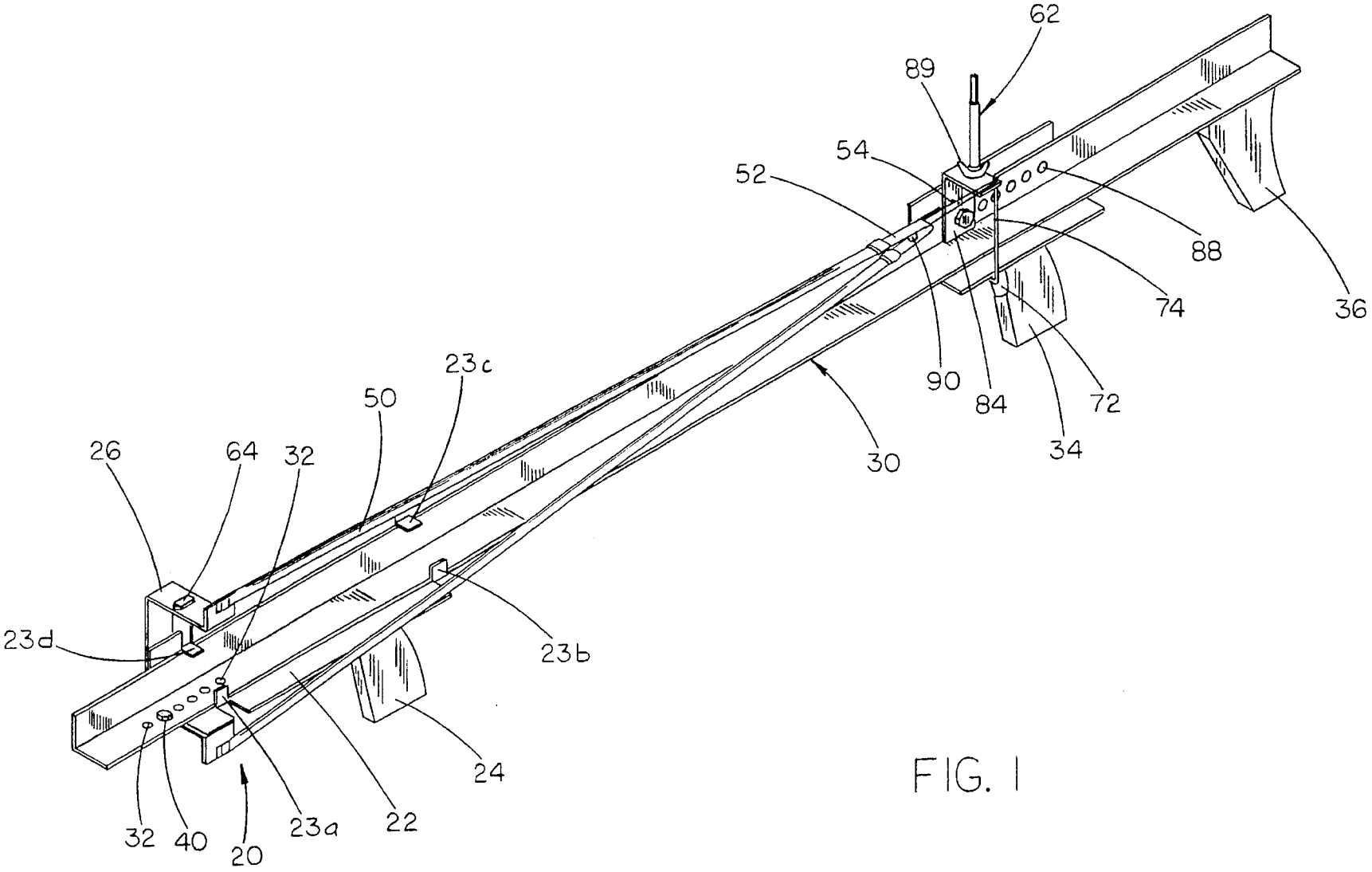
FIG. 1 is a perspective view of the improved accuracy slingshot apparatus of the present invention.
Figure 3:
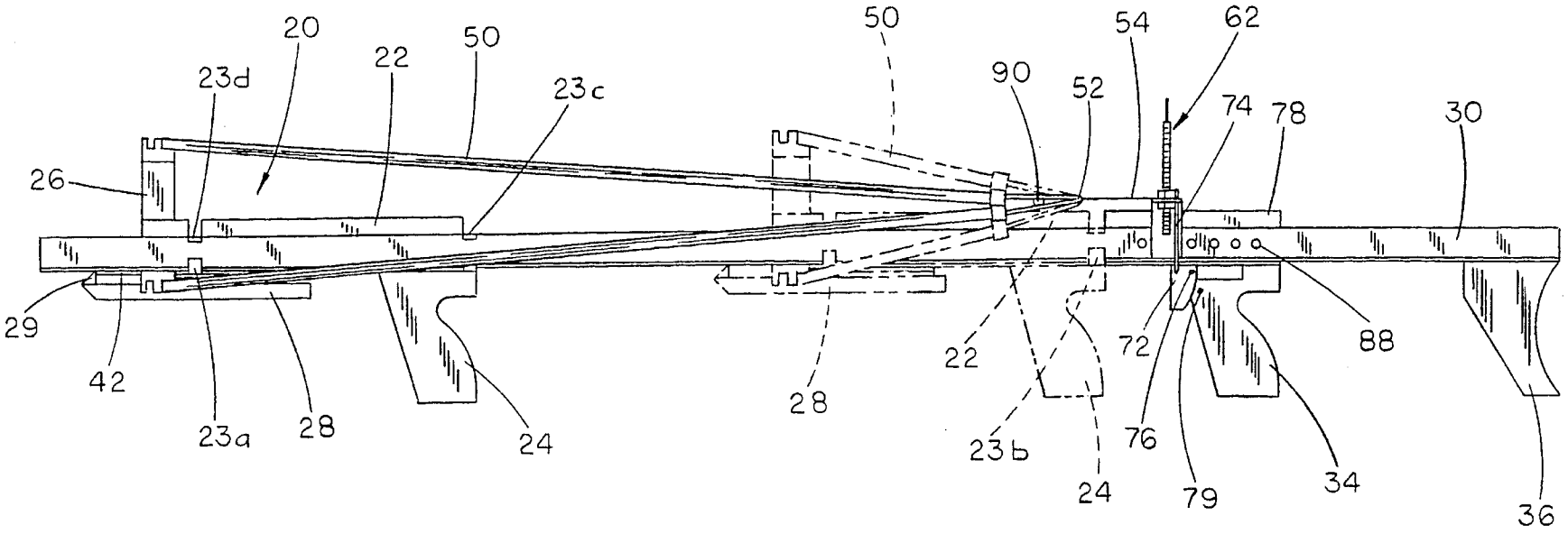
FIG. 3 is a side view of the slingshot apparatus with the movable carriage in the retracted, rearward holding position shown in phantom lines and in the extended, cocked position in solid lines.

The perspective view of FIG. 1 best illustrates the overall working configuration of the improved accuracy slingshot apparatus of the present invention. As seen in this figure, an elongated stationary support channel 30 forms the central structure around which the remaining components are built. As seen in the figure, the elongated stationary support channel 30 comprises a generally L-shaped member. This shape provides structural support as well as clearance for travel of pouch 52 and projectile 90. In the forward portion of elongated stationary support channel 30 is placed a series of holes 32 for mounting of locking means 40. As will be described in more detail below, locking means 40 is adapted to lock the movable carriage 20 in the extended, forward cocked position as shown. A plurality of holes 32 allow the position of locking means 40 to be moved lengthwise along the elongated stationary support channel 30. As will also be described in more detail below, the positioning of locking means 40 along stationary support channel 30 determines the extent to which elongated elastic band means 50 is stretched. Consequently, the positioning of locking means 40 determines the initial projectile velocity and thus the distance the projectile 90 will travel. As is well understood by anyone acquainted with slingshots, it is the elongated elastic band 50 which, when released, propels a projectile 90 forwardly. As seen in FIGS. 1 and 3, projectile 90 is releasably held in pouch 52 by frictional engagement. As seen in the figures, when trigger 74 engages lanyard 54, pulling band 50 taut, pouch 52 assumes a "V" shape with projectile 90 fitting snugly in the apex thereof, thereby achieving a degree of frictional engagement sufficient to releasably retain projectile 90.

Figure 8:
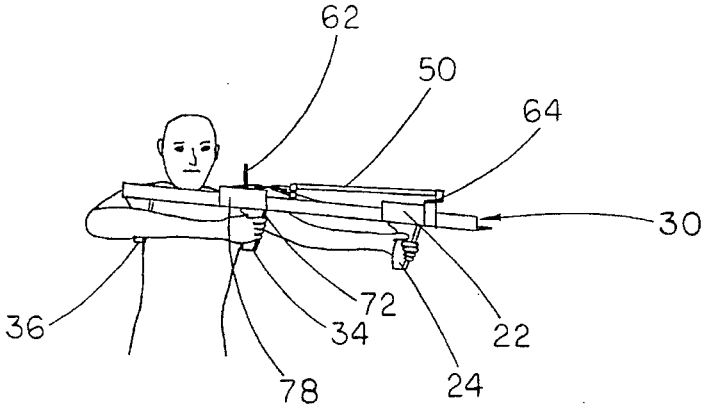
FIG. 8 is a perspective view showing the slingshot apparatus in use.

Elongated stationary support channel 30 may also have handgrip 34 and shoulder butt stock 36 secured to the underside thereof and positioned in the rearward portion thereof as illustrated in the figure. The purpose for handgrip 34 and shoulder butt stock 36 is to provide a means of stabilizing the slingshot apparatus for sighting and firing (Fig. 8). A sighting means 60 is provided for sighting of the slingshot apparatus thereby enhancing its accuracy. The vertical orientation of the band 50 as illustrated, has important implications for sighting means 60 as discussed below.

Figure 2:
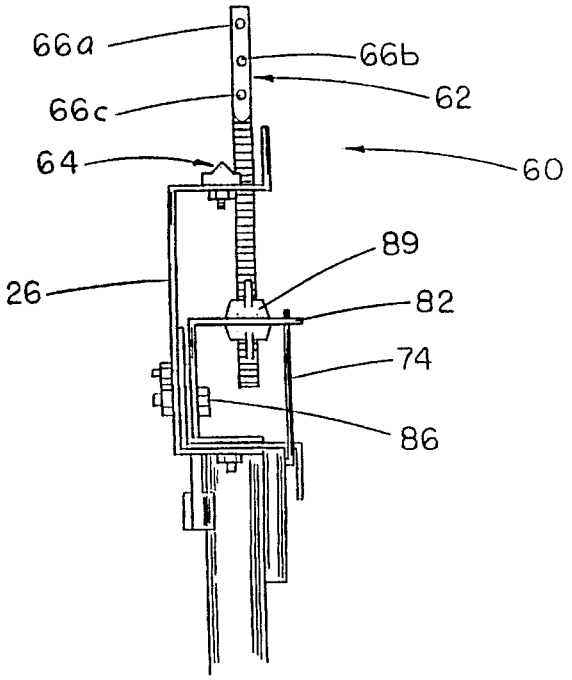
FIG. 2 is an end view of the movable carriage which is slidably engaged to the main elongated stationary support channel showing the installation of the elastic band means mounting yoke thereon.

In the present invention, the sighting means 60 comprises forward and rearward sighting members 64 and 62, respectively. As seen in FIG. 1, the rear sighting member 62 is positioned above and slightly forwardly of handgrip 34. Height adjustment of sight 62 may be made by loosening locking nut 89. FIG. 2 illustrates the positioning of the forward sighting member 64 and will be described in connection therewith. Trigger means 70 is illustrated in the perspective view of FIG. 1 pivotally attached to handgrip 34. The operation of trigger means 70 will be discussed in more detail below in connection with FIGS. 4 and 6. Finally, the movable carriage 20 is illustrated.

Movable carriage 20 comprises a generally L-shaped channel 22 adapted to slide lengthwise along elongated stationary support channel 30. Slidable engagement between movable carriage 20 and elongated stationary support channel 30 is maintained by a plurality of locking tabs 23*a–d*. It will also be seen from the figure, that in addition to L-shaped member 22, the movable carriage 20 comprises a bracket 26 mounted to the outward surface thereof by means of screws or other similar semi-permanent means. Bracket 26 is used to secure the two ends of elastic band means 50 to slidable carriage 20. The attachment of bracket 26 to slidable carriage L-shaped member 22 is illustrated more clearly in the front view of FIG. 2. Finally, FIG. 2 illustrates an additional forward handgrip 24 secured to the underside of L-shaped channel 22 on slidable carriage 20. The purpose for handgrip 24 is twofold. First, it provides a means for sliding movable carriage 20 to the forward, cocked position. Secondly, it provides an additional means for holding the slingshot apparatus as illustrated below in FIG. 8.

FIG. 2 is an end view of the slidable movable carriage 20 showing the L-shaped channel member 22 and the associated bracket 26 used to connect and support the two ends of elastic band means 50. Also indicated in this view is the forward sighting member 64 of sighting means 60. As indicated by direction arrow 66, the forward sighting member 64 is adapted to be moved horizontally against the top surface of bracket 26. Additionally, the vertical height of the sight 62 may be adjusted by loosening locking nut 89. It will be observed from FIG. 2 that a plurality of vertically spaced sighting apertures 66*a–c* are provided in sighting means 62. The purpose for providing a plurality of sighting apertures 66*a–c* is that a plurality of target distances can be specified without the need of altering the sight each time a new target distance is to be sighted in. For example, the top sighting aperture 66*a* provides the highest sighting angle corresponding to the furthest targeting distance. Conversely, the lowest sighting aperture 66*c*, corresponds to the lowest sighting angle and consequently the nearest target distance. Thus, a plurality of target sighting distances may be provided simply by providing a plurality of vertically spaced sighting apertures.

FIG. 3 is a side view of the apparatus with the movable carriage 20 in the retracted, rearward holding position shown in phantom lines. It will be observed from this figure that the elastic band means 50 is pulled tight but is not stretched. It may be seen from the figure that the trigger pin 74 has releasably engaged the pouch 52 by means of a lanyard 54.

FIG. 3 also illustrates, in solid lines, the improved accuracy slingshot apparatus of the present invention with the movable carriage 20 in the forward, cocked position and with the elastic band means 50 outstretched. It can also be seen from this figure, that the movable carriage 20 is releasably retained in this forward, cocked position by the engagement of tab 29 on locking arm 28 with stub 42 of locking means 40 attached to the underside of support channel 30 in the forward portion thereof. The releasable retention of carriage 20 in the forward position is illustrated more clearly in FIG. 7.

Figure 6:
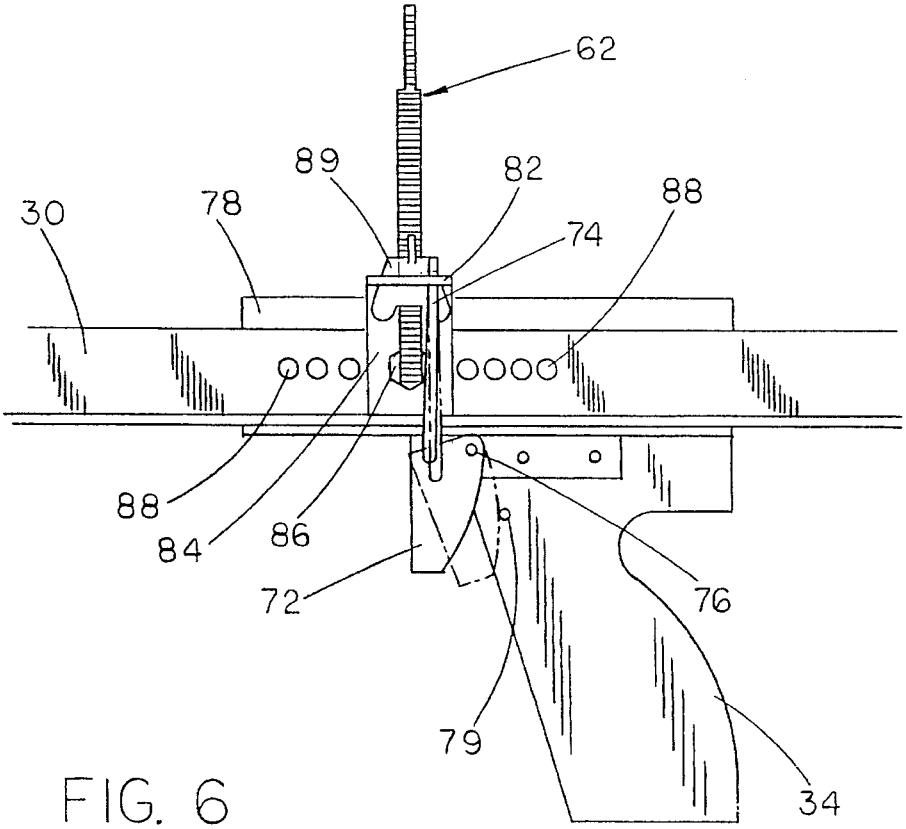
FIG. 6 is an enlarged side view of the trigger means and its movement between a release (in phantom lines) position and in the cocked position (in solid lines).

It will also be clear from FIG. 3, that the releasable engagement of lanyard 54 by trigger pin 74 is operative to retain the elastic band means 50 in the extended, cocked position until trigger means 70 releases trigger pin 74. As seen in the figure and described in more detail below, trigger 72 is pivotally mounted to handle 34 by means of screw 76. Rearward pivoting of trigger 72 is operative to vertically displace pin 74 downwardly below the surface level of plate 82. The attachment and movement of the trigger means 70 is best illustrated in FIG. 6 below.

Figure 4:
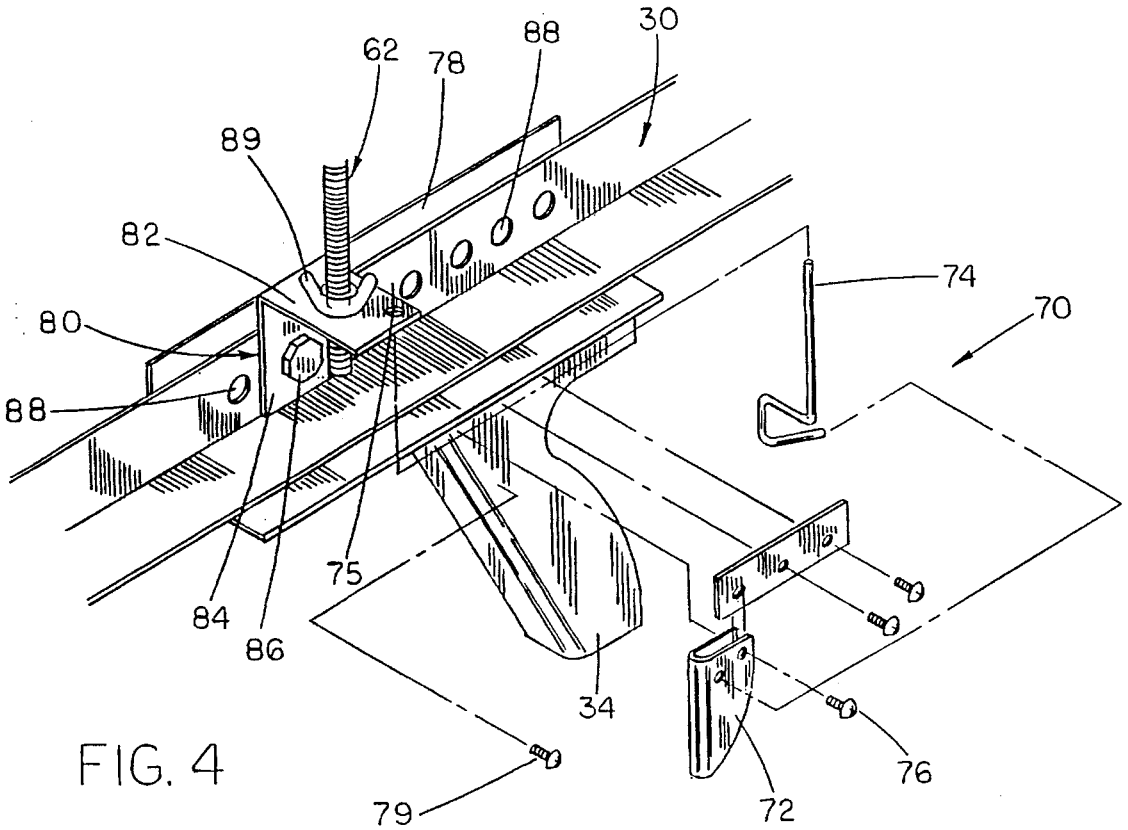
FIG. 4 is an exploded view of the trigger and rear sighting mechanism of the apparatus.

FIG. 4 is an exploded view of the trigger means 70. The lengthwise adjustable position of trigger means 70 and associated bracket 80 and handgrip 34 is particularly well illustrated in this figure. As seen in the figure, bolt 86 is adapted to releasably secure bracket 80 in the desired position along stationary support channel 30 by means of engagement with one of the plurality of holes 88 positioned lengthwise along channel 30. Therefore, positioning of bracket 80 and associated trigger means and sight 62 may be adjusted simply by removing bolt 86, repositioning bracket 80 and reinstalling and tightening bolt 86.

As seen in the figure, rear sight 62 is fixed in vertical position by means of locking nut 89. Thus, the vertical positioning of sight 62 may be accomplished by loosening nut 89, adjusting the position of sight 62, and re-tightening nut 89. Such a repositioning of the sight might be required for example to adjust the targeting distance. Alternatively, adjustment of the sight might be required if the trigger means 70 and bracket 80 are repositioned as indicated above. The vertical position of the sight may need to be adjusted to achieve the same, previously designated, target distance.

Figure 5:
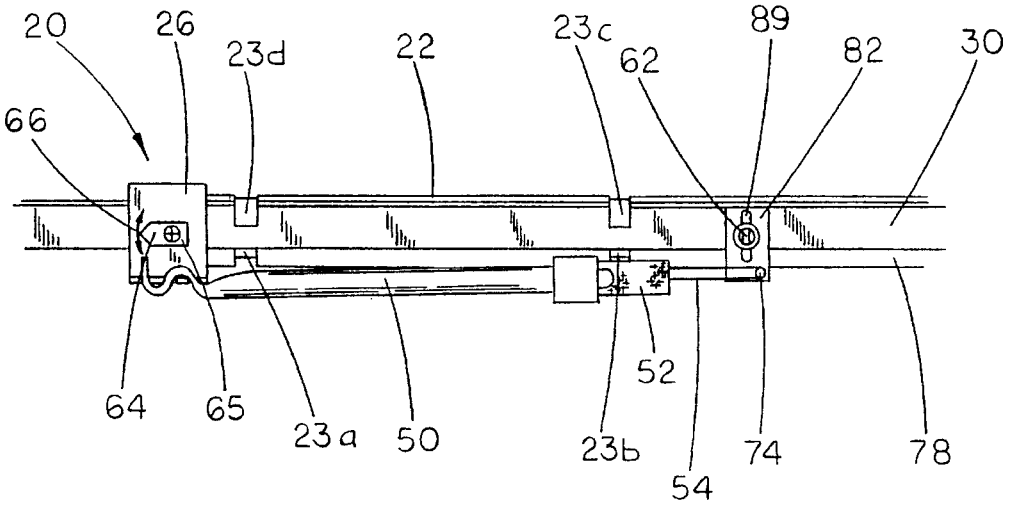
FIG. 5 is a top view showing the alignment of the sighting mechanism in addition to the vertical mounting of the elastic band means.

FIG. 5 is a top view illustrating with particular clarity the alignment of sighting means 60 as well as the releasable engagement of pouch 52 and elastic band means 50 to trigger means 70 using the lanyard 54. As seen in the figure, the portion of trigger pin 74 which projects upwardly through the horizontal plate 82 of bracket 80 is adapted to engage the lanyard 54 which forms a loop around this protruding portion of pin 74. The other ends of lanyard 54 are securely fastened to pouch 52 such that when the lanyard 54 is engaged with pin 74, it will releasably secure elastic band means 50 in the retracted, rearward holding position as shown. In the preferred embodiment, lanyard 54 is constructed from 75 pound test fishing line but may be constructed from other suitable material.

An important feature of the present invention is illustrated in the top view of FIG. 5, namely the vertical alignment of the sighting means with the departure vector. As seen in the figure, the forward and rearward sights 64 and 62, respectively, are positioned adjacent the elastic band means 50. Thus, the targeting accuracy of the apparatus is enhanced. As seen in the figure, forward sighting member 64 is pivotally fastened to the upper horizontal arm of bracket 26 by means of screw 65. Screw 65 permits the horizontal adjustment of forward sighting member 64 in the manner illustrated by arrows 66 simply by loosening the screw 65. As is well understood in the art, this lateral adjustment of the forward sight 64 is referred to as the windage adjustment.

FIG. 6 is an enlarged side view of the trigger mechanism 70 of the present invention. As seen in the figure, trigger 72 is pivotally connected to handgrip 34 by means of pin or screw 76. As seen in the figure, this permits the front to back pivotal movement indicated by the direction arrow in the figure. Trigger 72 is illustrated in the rearward, release position in phantom lines and in the forward, engagement position in the solid line. As shown, movement of the trigger 72 from the forward engagement position to the rearward release position causes pin 74 to move downwardly, causing the portion of pin 74 protruding above plate 82 to be retracted. This downward retraction of pin 74 into plate 82 releases lanyard 54 allowing elastic band means 50 to contract. The contraction of band 50 propels the projectile 90, releasably engaged with pouch 52, forwardly. In the preferred embodiment, projectile 90 would be a lead ball of approximately 140 grains weight but could be any number of suitable alternatives, In the preferred embodiment, trigger means 70 also comprises a post 79 which is inserted into handgrip 34 and adapted to contact the rear edge of trigger 72 when pivoted rearwardly to the release position. Thus, post 79 is operative to limit the rearward travel of trigger 72. While not essential to the operation of the apparatus, stop post 79 prevents release trigger pin 74 from traveling downwardly too far and disengaging from plate 82. This prevents the operator from having to reinsert release trigger pin 74 into the hole in plate 82 after each shot. As mentioned above, vertical member 84 of bracket 80 is releasably secured in position to the stationary support channel 30 by means of securement bolt 86. As seen in the figure, a plurality of holes 88 are provided in stationary support channel 30 for adjusting the position of vertical wall 84 and thus bracket 50 lengthwise along stationary support channel 30. The position of bracket 80 may be adjusted simply by loosening and removing bolt 86, repositioning bracket 80 and reinstalling and tightening bolt 86. As mentioned above, after such an adjustment, it may be necessary to re-adjust sighting means 60 and, in particular, the vertical positioning of rear sight 62.

Figure 7:
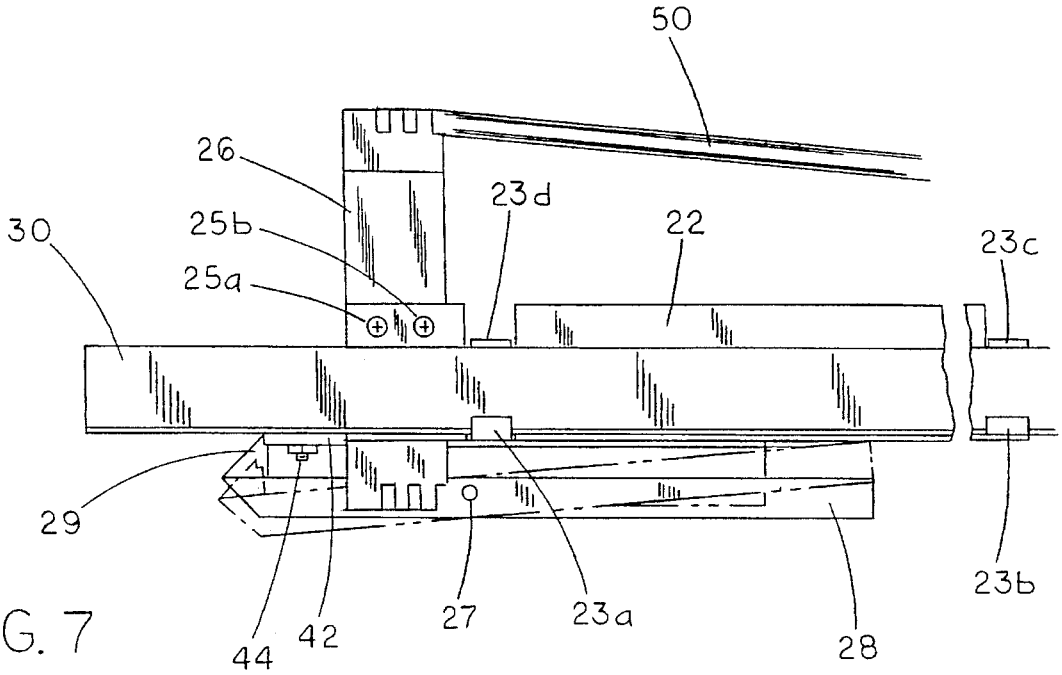
FIG. 7 is a side view of the forward portion of the apparatus showing the movable carriage in the forward, cocked position and illustrating the release lever used to disengage the forward locking means.

FIG. 7 is an enlarged view of the forward portion of the slingshot apparatus with the movable carriage 20 in the extended, forward cocked position. As seen in this figure and as discussed above, the movable carriage 20 is releasably retained in the extended, forward cocked position by means of locking means 40 and the releasable engagement of locking arm 28 therewith. Locking arm 28 is pivotally connected to movable carriage 20 by means of pin 27. The position of locking arm 28 is adjustable between a locked position indicated in solid lines and a release position indicated by phantom lines. As indicated in the figure, when in the locking position, arm 28 is positioned such that tab 29 engages the forward portion of stub 42 of locking means 40. Locking means 40 is attached to the underside of support channel 30 by means of a bolt 44 or the like. Tension in band 50 urges tab 29 against stub 42, preventing rearward movement of carriage 20. Once the slingshot has been released, or it is desired to uncock the slingshot, the rear portion of locking arm 28 would be pivoted upwardly as indicated by the phantom line. Tab 29 and locking stub 42 would be disengaged, allowing the rearward travel of movable carriage 20. Also seen in this figure are the plurality of tabs 23*a–d* providing a means for slidably retaining carriage 20 on stationary support channel 30. As mentioned above, a plurality of holes 32 (FIG. 1) are drilled into the underside of the support channel 30 and through which a bolt or screw 44 is placed to releasably secure stub 42 to the underside thereof. Thus, a means is provided for adjusting the position of locking stub 42 lengthwise along stationary support channel 30 simply by removing bolt 44, adjusting the position of stub 42 and reinstalling bolt 44. Also shown in this figure is the means by which the two portions of the elastic band means 50 are secured to bracket 26. As seen in the figure, a plurality of slits are cut into the top arm of bracket 26 allowing the ends of elastic band means 50 to be threadably received therebetween. The pressure contact and resulting frictional engagement of the ends of elastic band means 50 operate to secure the elastic band means 50 in place. Bracket 26 is then rigidly secured to movable carriage 20 by means of a plurality of screws 25*a* and 25*b*.

FIG. 8 is an illustration of the operation of the apparatus. As seen in this figure, the forward grip 24 is used to slide carriage 20 forwardly into the locking position, thereby extending elastic band means 50. Shoulder butt stock 36 is then placed against the shoulder and the remaining handgrip 34 is grasped with the index finger resting on the trigger 72. Sight 62 is then used in conjunction with the forward sight 64 to adjust the position of the apparatus in much the same way as with a conventional firearm. Once the target is acquired, the trigger is depressed and the projectile released.

It is obvious that numerous other modifications and variations of the present invention are possible in view of the above teachings. For example, as mentioned the construction materials for various components of the structure such as the projectile and lanyard may be altered. Additionally, the L-shape of the elongated channel is not critical.

Therefore it is to be understood that the above description is in no way intended to limit the scope of protection of the claims and is representative only of the several possible embodiments of the present invention.

There has thus been shown and described an invention which accomplishes at least all of the stated objects.

I claim:

1. A slingshot device to improve the accuracy thereof comprising:

an elongated stationary support channel having forward and rearward portions;

a movable carriage slidably engaged by said stationary support channel and movable between an extended, forward cocked position and a retracted rearward holding position;

locking means mounted on the forward portion of said elongated stationary support channel and operative to releasably lock said carriage in the extended, forward cocked position;

an elongated elastic band means having opposite ends mounted in vertically spaced relation on said carriage and including a pouch for releasably retaining the projectile at a midpoint of said elastic band means;

said pouch including a release lanyard;

a trigger means on said stationary support channel and movable between an engagement position in releasable engagement with the lanyard of said elastic band means, and a release position such that upon movement of the trigger means to the engagement position and upon engagement of said lanyard with said trigger means and upon movement of said carriage to the forward cocked position, said elastic band means is substantially stretched and upon movement of the trigger means to the release position, said elastic band means is operative to propel a projectile in said pouch forwardly, defining a line of departure; and sighting means on said support channel and carriage positioned above said line of departure.

2. A slingshot device for accurate shooting of a projectile comprising:

an elongated stationary support channel having forward and rearward portions;

a movable carriage slidably engaged by said stationary support channel and movable between an extended, forward position and a retracted rearward holding position;

an elongated elastic band means having opposite ends mounted in vertically spaced relation on said carriage and including a pouch at a midpoint of said elastic band means for releasably retaining the projectile;

a trigger means on said stationary support channel and movable between an engagement position in releasable engagement with the pouch of said elastic band means, and a release position such that upon movement of the trigger means to the engagement position and upon engagement of said pouch with said trigger means and upon movement of said carriage to the forward position, said elastic band means is substantially stretched and upon movement of the trigger means to the release position, said elastic band means is operative to propel a projectile in said pouch forwardly, defining a line of departure; and sighting means on said support channel and carriage positioned above said line of departure.

3. A slingshot device for accurate shooting of a projectile comprising:

an elongated stationary support channel having forward and rearward portions;

a movable carriage slidably engaged by said stationary support channel and movable between an extended, forward cocked position and a retracted rearward holding position;

locking means mounted on the forward portion of said elongated stationary support channel and operative to releasably lock said carriage in the extended, forward cocked position;

an elongated elastic band means having opposite ends mounted in vertically spaced relation on said carriage and including a pouch at a midpoint of said elastic band means for releasably retaining the projectile;

a trigger means on said stationary support channel and movable between an engagement position in releasable engagement with the pouch of said elastic band means, and a release position such that upon movement of the trigger means to the engagement position and upon engagement of said pouch with said trigger means and upon movement of said carriage to the forward cocked position, said elastic band means is substantially stretched and upon movement of the trigger means to the release position, said elastic band means is operative to propel a projectile in said pouch forwardly, defining a line of departure; and sighting means on said support channel and carriage positioned above said line of departure.

4. The slingshot device of claim 3 further comprising handgrips on said carriage and on said support channel adjacent said trigger means.

5. The slingshot device of claim 3 wherein the position of said locking means on said support channel is adjustable for adjustment of the tension in said elastic band, corresponding to the forward cocked position of the carriage.

6. The slingshot device of claim 3 wherein said sighting means comprises a sight having a plurality of sighting heights corresponding to a plurality of target distances.

7. The slingshot device of claim 6 wherein said sighting means further comprises a forward sight mounted on said carriage above said elastic band means and a rear sight mounted on said support channel above said trigger means.

8. The slingshot device of claim 3 wherein said elongated stationary support channel and said movable carriage, are generally "L" shaped channels.

9. The slingshot device of claim 3 wherein said trigger means is a pin.

10. The slingshot apparatus of claim 3 further comprising means for adjusting the position of said locking means mounted on said forward portion of said elongated stationary support channel.

11. The slingshot apparatus of claim 3 further comprising means for adjusting the position of said trigger means on said stationary support channel.

* * * * *